US009976460B2

(12) United States Patent
Khan

(10) Patent No.: US 9,976,460 B2
(45) Date of Patent: May 22, 2018

(54) EXHAUST AFTER-TREATMENT ASSEMBLY FOR ENGINE SYSTEM

(71) Applicant: Caterpillar Inc., Peoria, IL (US)

(72) Inventor: Faiz M. I. Khan, Dunlap, IL (US)

(73) Assignee: Caterpillar Inc., Deerfield, IL (US)

( * ) Notice: Subject to any disclaimer, the term of this patent is extended or adjusted under 35 U.S.C. 154(b) by 0 days. days.

(21) Appl. No.: 15/079,536

(22) Filed: Mar. 24, 2016

(65) Prior Publication Data

US 2017/0276043 A1 Sep. 28, 2017

(51) Int. Cl.

| | |
|---|---|
| ***F01N 3/10*** | (2006.01) |
| ***F01N 3/033*** | (2006.01) |
| ***F01N 1/02*** | (2006.01) |
| ***F01N 1/08*** | (2006.01) |
| ***F01N 3/035*** | (2006.01) |
| ***F01N 3/20*** | (2006.01) |
| ***F01N 3/28*** | (2006.01) |

(52) U.S. Cl.

CPC ..... *F01N 3/0335* (2013.01); *F01N 1/026* (2013.01); *F01N 1/083* (2013.01); *F01N 3/035* (2013.01); *F01N 3/103* (2013.01); *F01N 3/2066* (2013.01); *F01N 3/2885* (2013.01); *F01N 2450/40* (2013.01)

(58) Field of Classification Search

USPC ..... 60/274, 299, 305, 312, 313, 314, 322, 60/323, 324

See application file for complete search history.

(56) References Cited

U.S. PATENT DOCUMENTS

| | | | | |
|---|---|---|---|---|
| 5,396,767 | A * | 3/1995 | Suzuki | F01N 3/30 422/172 |
| 5,808,245 | A * | 9/1998 | Wiese | F01N 3/005 181/255 |
| 6,550,573 | B2 * | 4/2003 | Wagner | F01N 1/003 181/255 |
| 6,892,854 | B2 | 5/2005 | Wagner et al. | |
| 7,464,543 | B2 * | 12/2008 | Chrisman | F01N 1/166 181/249 |
| 7,997,071 | B2 | 8/2011 | Blaisdell | |
| 8,635,861 | B2 | 1/2014 | Sun et al. | |

(Continued)

FOREIGN PATENT DOCUMENTS

| | | |
|---|---|---|
| CN | 202431338 | 9/2012 |
| CN | 104564252 | 4/2015 |

*Primary Examiner* — Binh Q Tran

(57) ABSTRACT

An exhaust after-treatment assembly for an engine system is provided. The exhaust after-treatment assembly includes a housing having an inlet port, an outlet port, a catalyst disposed within a cavity defined by the housing, and a muffler assembly disposed within the cavity downstream of the catalyst. The muffler assembly includes one or more baffle plates disposed longitudinally spaced from one another within the housing to define at least a first resonator chamber and a second resonator chamber. Each of the baffle plates defines an openings aligned to one another about a longitudinal axis of the housing. Further, a resonator tube extends through the openings of the baffle plates and includes an inlet, a perforated portion and one or more outlet ports formed in a wall of the resonator tube. The perforated portion and the outlet ports, respectively in fluid communication with the second resonator chamber and the first resonator chamber.

16 Claims, 7 Drawing Sheets

(56) References Cited

U.S. PATENT DOCUMENTS 8,752,370 B2 6/2014 Hittle et al.
8,850,801 B2 * 10/2014 Baig ..... F01N 3/2885
60/295

* cited by examiner

EXHAUST AFTER-TREATMENT ASSEMBLY FOR ENGINE SYSTEM

TECHNICAL FIELD

The present disclosure relates to an exhaust after-treatment assembly, and more particularly to a method of retrofitting the exhaust after-treatment assembly by replacing a diesel particulate filter with a muffler assembly.

BACKGROUND

Aftertreatment systems, for treating emissions of an engine, are well known in the art. An aftertreatment system typically includes a diesel particulate filter (DPF) in addition to other emission treatment catalyst such as a diesel oxidation catalyst and/or a nitrous oxide reduction catalyst. The DPF filters particulate matter present in exhaust gas of the engine.

The particulate matter trapped in the DPF is removed periodically by regeneration. Regeneration may involve using a heat source (not shown) to combust the particulate matter. The residual matter, present in the DPF after combustion, may have to be removed regularly. The removal of the residual matter may involve a recurring maintenance cost and down time. Further, the DPF may also have to be replaced regularly.

The DPF is typically provided to conform to emission requirements in certain jurisdictions. However, other jurisdictions may have less strict emission requirements such that the DPF is not an essential component for treatment of exhaust gas. In such jurisdictions, the DPF may therefore entail avoidable maintenance and/or replacement costs. However, when the DPF is removed, the engine noise becomes too high which is undesirable.

U.S. Pat. No. 6,892,854 discloses muffler assembly having an upstream sound attenuating region, a downstream sound attenuating region, and a catalytic converter region between the upstream and downstream sound attenuating regions. The upstream sound attenuating region includes flow distribution arrangement to direct the exhaust gas through the catalytic converter region. Although, the patent discloses a combined muffler and catalytic converter arrangement, the patent does not disclose retrofitting of a sound attenuating arrangement in an exhaust after-treatment system.

SUMMARY OF THE INVENTION

According to an aspect of the disclosure, an exhaust after-treatment assembly for an engine system is disclosed. The exhaust after-treatment assembly includes a housing having an inlet port and an outlet port, a catalyst disposed within a cavity defined by the housing, and a muffler assembly disposed within the cavity of the housing and positioned downstream of the catalyst. The muffler assembly includes one or more baffle plates disposed within the housing and positioned downstream of the catalyst. The baffle plates are longitudinally spaced from one another to define at least a first resonator chamber and a second resonator chamber. Further, each of the baffle plates defines an opening aligned with one another about a longitudinal axis of the housing. Further, the muffler assembly includes a resonator tube extending through the opening of each of the baffle plates. The resonator tube includes an inlet to receive exhaust gas exiting the catalyst. The resonator tube further includes a perforated portion and one or more ports formed in a wall of the resonator tube, and respectively in fluid communication with the second resonator chamber and the first resonator chamber.

According to another aspect of the disclosure, an engine system is disclosed. The engine system includes an engine and an exhaust after-treatment assembly coupled to the engine and configured to treat exhaust gas discharged from the engine. The exhaust after-treatment assembly includes a housing having an inlet port and an outlet port, a catalyst disposed within a cavity defined by the housing, a plurality of baffle plates disposed within the cavity of the housing and positioned downstream of the catalyst. The baffle plates are longitudinally spaced from one another to define at least a first resonator chamber and a second resonator chamber. Further, each of the baffle plate defines an opening aligned with one another about a longitudinal axis of the housing. Further, the exhaust after-treatment assembly includes a resonator tube extending through the opening of each of the baffle plates. The resonator tube includes an inlet to receive exhaust gas exiting the catalyst. The resonator tube further includes a perforated portion and one or more outlet ports formed in a wall of the resonator tube, and respectively in fluid communication with the second resonator chamber and the first resonator chamber.

According to another aspect of the disclosure, a method for retrofitting a pre-existing after-treatment assembly having a catalyst and a diesel particulate filter is disclosed. The method includes removing the diesel particulate filter from a housing of the pre-existing after-treatment assembly and inserting a muffler assembly inside the housing downstream of the catalyst. The inserting of the muffler assembly includes providing a plurality of longitudinally spaced baffle plates having aligned openings and defining at least a first resonator chamber and a second resonator chamber within the housing. The inserting of the muffler assembly also includes providing a resonator tube extending through the openings. The resonator tube includes an inlet to receive exhaust gas discharged from the catalyst. The resonator tube further includes a perforated portion, and one or more outlet ports, respectively in fluid communication with the second resonator chamber and the first resonator chamber.

DETAILED DESCRIPTION

Figure 1:
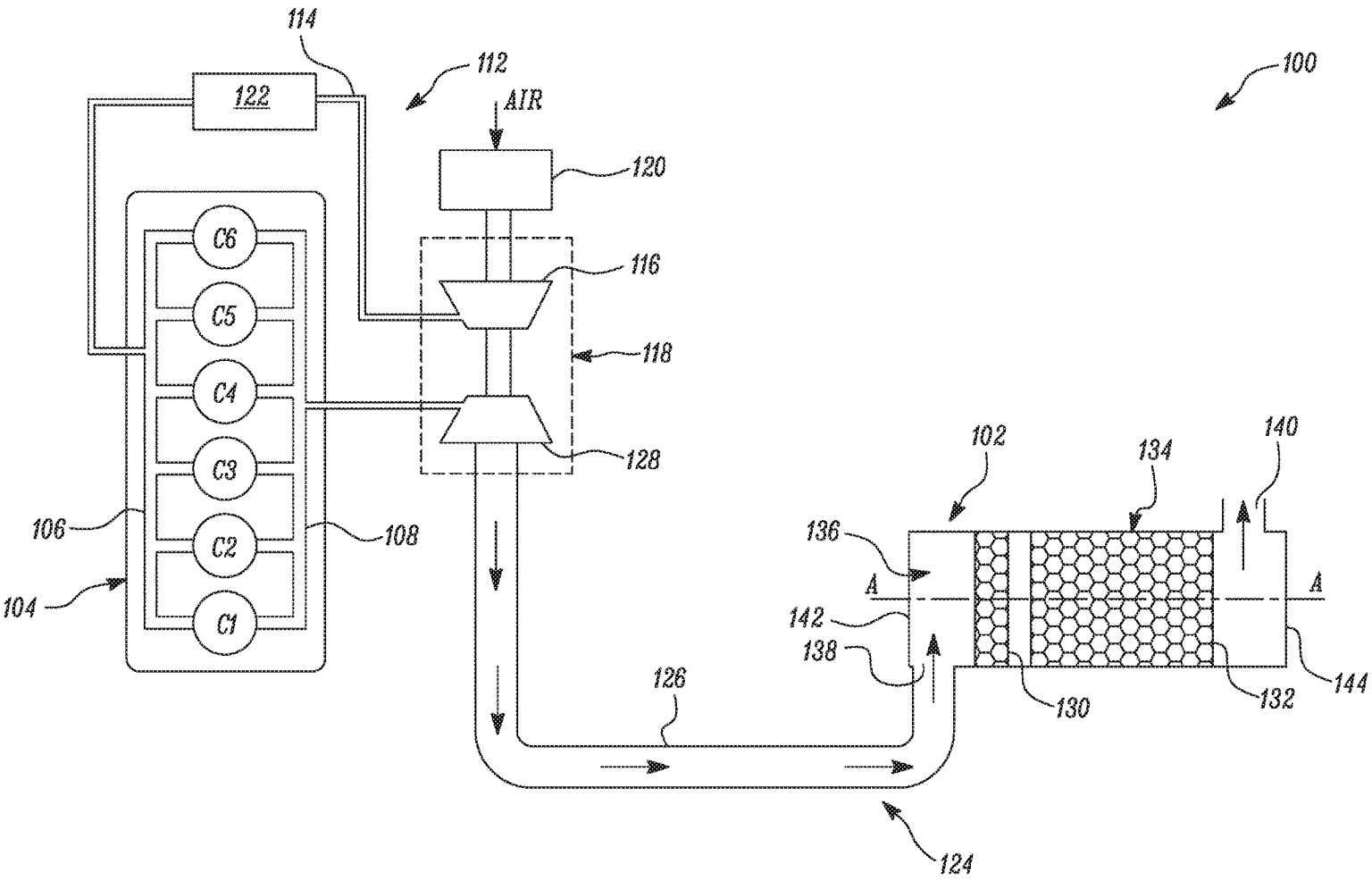
FIG. 1 illustrates an engine system having a pre-existing after-treatment assembly.

Wherever possible, the same reference numbers will be used throughout the drawings to refer to the same or the like parts. Referring to FIG. 1, there is shown an engine system 100 including a pre-existing exhaust after-treatment assembly 102. The engine system 100 includes an engine 104 which may be a gasoline engine, a gaseous engine, a diesel engine or a dual fuel engine. The gaseous engine may use natural gas, propane gas, methane gas or any other gaseous fuel suitable for use in the gaseous engine. The engine may be a single cylinder or a multi cylinder engine. Further, the engine 104 may be a two stroke engine, a four stroke engine, or a six stroke engine. Also, the engine 104 may be a spark ignited engine, a compression ignition engine, a distributed ignition engine or a homogeneous charge compression ignition engine.

As shown in FIG. 1, the engine 104 may include an intake manifold 106, an exhaust manifold 108, and a plurality of combustion cylinders C1 through C6. The intake manifold 106 and the exhaust manifold 108 are each fluidly coupled with a plurality of combustion cylinders C1 through C6. In the embodiment shown, a single intake manifold 106 and exhaust manifold 108 are fluidly coupled with combustion cylinders C1 through C6. However, it is also possible to configure the intake manifold 106 and/or the exhaust manifold 108 as a split or multiple-piece manifold, each associated with a different group of combustion cylinders.

The intake manifold 106 may be fluidly coupled to an air induction system 112. The air induction system 112 may include an intake air conduit 114 and a compressor 116. The compressor 116 may be fluidly coupled to the intake manifold 106 by the intake air conduit 114. The compressor 116 is configured to compress air before delivering to the combustion cylinders C1 to C6. The compressor 116 may be a compressor of a turbocharger 118 (as shown) or a compressor of a supercharger. Although, the turbocharger 118 is contemplated, other means of providing air such as intake conduit, a throttle valve, an air reservoir known to one skilled in art would also apply. The air induction system 112 may also include one of more filters 120 positioned upstream of the compressor 116. The filters 120 may remove any undesired constituents such as dust particles from the air before delivering to the compressor 116. Further, a heat exchanger 122 may be positioned downstream of the compressor 116 to cool the compressed air coming from the compressor 116 before delivering to the combustion cylinders C1 to C6. For example, the heat exchanger 122 can be disposed within the intake air conduit 114.

Further, the engine system 100 may include an exhaust system 124 fluidly coupled to the exhaust manifold 108. The exhaust system 124 receives exhaust gases discharged by the combustion cylinders C1 to C6 via the exhaust manifold 108. The exhaust system 124 may include an exhaust conduit 126 and the pre-existing exhaust after-treatment assembly 102. The exhaust conduit 126 is fluidly coupled to the exhaust manifold 108 to receive the exhaust gas. The exhaust system 124 may include a turbine 128 positioned upstream of the pre-existing exhaust after-treatment assembly 102. As shown in FIG. 1, the turbine 128 is driven by exhaust gas discharged from the combustion cylinders C1 to C6 and drive the compressor 116 to compress the air. The turbine 128 may be a component of the turbocharger 118 (as shown).

Further, the exhaust conduit 126 may deliver the exhaust gas to the pre-existing exhaust after-treatment assembly 102. The pre-existing exhaust after-treatment assembly 102 may remove various undesired or harmful constituents such as hydrocarbon, diesel particulate matter, nitrous oxide etc. from the exhaust gas before releasing to atmosphere.

As shown in FIG. 1, the pre-existing exhaust after-treatment assembly 102 may include at least one of a catalyst 130 and a diesel particulate filter (DPF) 132 positioned within a cavity 136 defined by a housing 134 along a longitudinal axis A-A of the housing 134 (both shown in housing). The housing 134 defines an inlet port 138 and an outlet port 140 to receive the exhaust gas from the engine 104 and discharge treated exhaust gases to the atmosphere, respectively. The housing 134 further may include a first end cap 142 and a second end cap 144. The first end cap 142 and/or the second end cap 144 may be removed to gain access to an inside of the housing 134.

When both present, the catalyst 130 and the DPF 132 can be arranged longitudinally spaced from each other with the housing 134 such that catalyst 130 is disposed upstream of the DPF 132. The catalyst 130 may be a diesel oxidation catalyst, a nitrous oxide reduction catalyst or a combination thereof. In the illustrated embodiment, the catalyst 130 is the diesel oxidation catalyst. The catalyst 130 may remove harmful constituents such as hydrocarbons, nitrous oxides etc. present in the exhaust gas. Further the DPF 132 filters the soot or any particulate matter present in the exhaust gas. Although DPF 132 is contemplated, any other suitable filter such as gasoline particulate filter suitable for use with a suitable engine may also be utilized.

Figure 2:
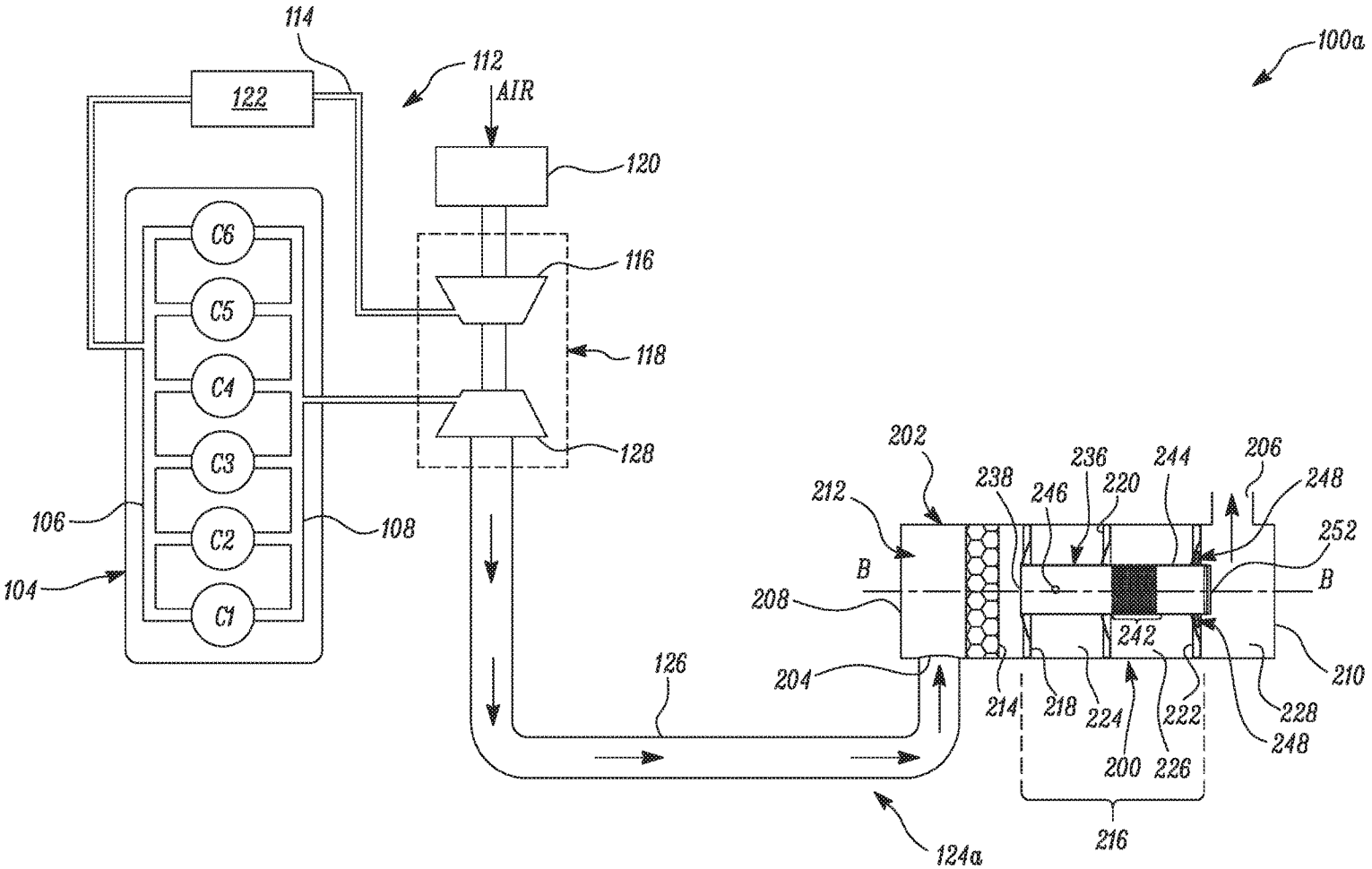
FIG. 2 illustrates an engine system having an exhaust after-treatment assembly, in accordance with an embodiment of the disclosure.

Referring to FIG. 2, an engine system 100*a* including an exhaust after-treatment assembly 200 is shown according to an embodiment of the present disclosure. Please note that elements of the engine system 100*a* that are common with the engine system 100 have the same numbers. The engine system 100*a* further may include the engine 104, the air induction system 112, and the exhaust system 124*a*. The exhaust system 124*a* may include the exhaust conduit 126 and the exhaust after-treatment assembly 200.

The exhaust after-treatment assembly 200 includes a housing 202 defining an inlet port 204 and an outlet port 206, and can include a first end cap 208 and a second end cap 210. The first end cap 208 may be in close proximity to the inlet port 204 and the second end cap 210 may be in close proximity of the outlet port 206. The first end cap 208 and/or the second end cap 210 may be removed to gain access to a cavity 212 defined by the housing 202. The exhaust after-treatment assembly 200 can include at least one of the catalyst 214 and a muffler assembly 216. When both present, the muffler assembly 216 is disposed within the cavity 212 and positioned downstream of the catalyst 214. Further, the muffler assembly 216 may be positioned longitudinally spaced from the catalyst 214 within the cavity 212. The catalyst 214 may be similar to the catalyst 130. The muffler assembly 216 is configured to attenuate the noise generated by the engine 104 and the exhaust gas discharged by the engine 104 during operation.

Figure 3:
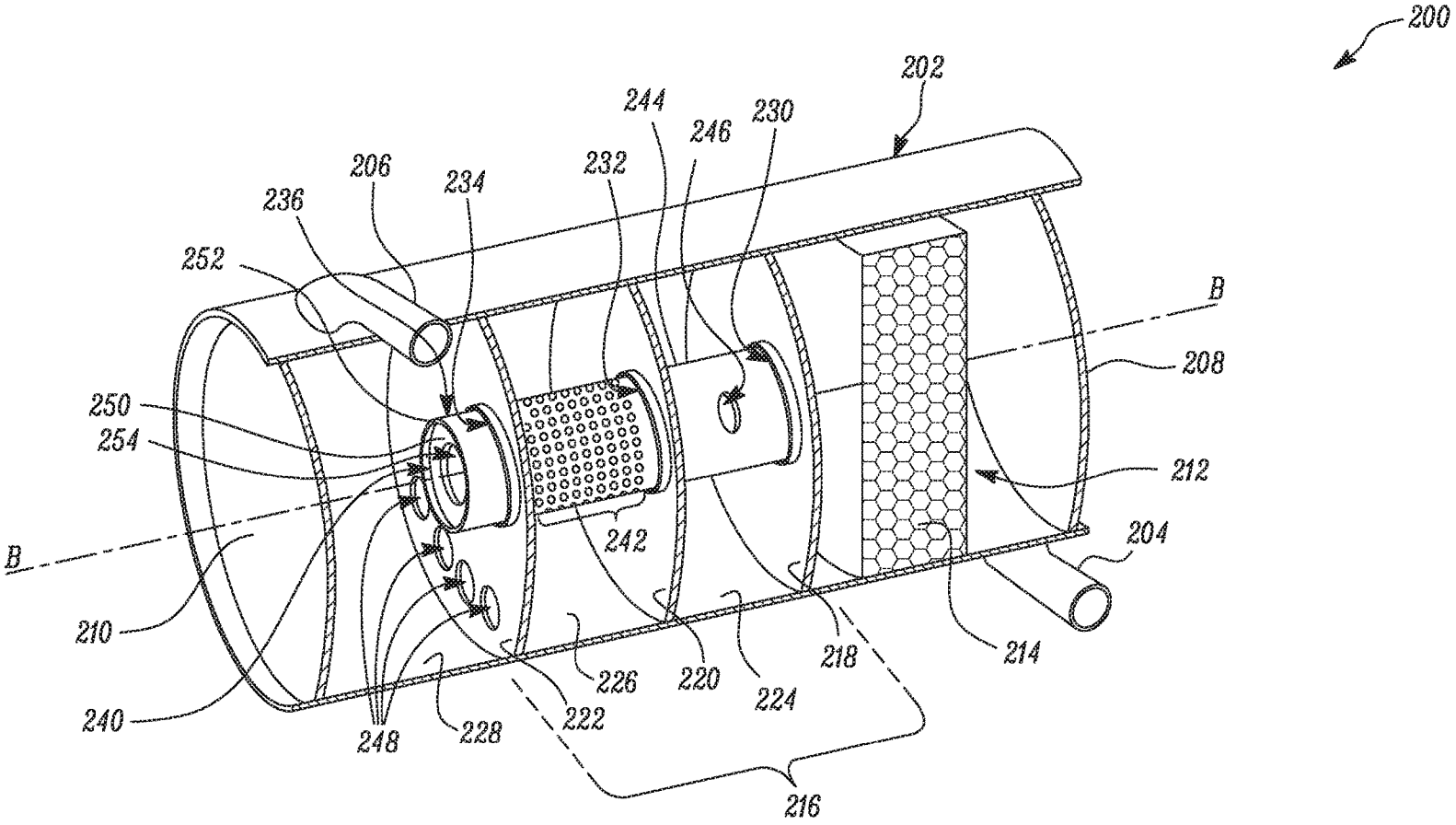
FIG. 3 illustrates a sectional view of the exhaust after-treatment assembly, in accordance with an embodiment of the disclosure.

As shown in FIGS. 2 and 3, the muffler assembly 216 can include one or more baffle plates. The one or more baffle plates can be longitudinally spaced and arranged parallely to each other within the cavity 212. Further, the one or more baffle plates may extend radially outward from a longitudinal axis B-B of the housing 202. For example, the muffler assembly 216 can include a first baffle plate 218, a second baffle plate 220, a third baffle plate 222, or any combination thereof, arranged longitudinally spaced from each other within the cavity 212 of the housing 202. Further, the baffle plates 218, 220, and 222 can be arranged perpendicular to the longitudinal axis B-B of the housing 202 such that the baffle plates 218, 220, and 220 extend radially outward from the longitudinal axis B-B. The first baffle plate 218 can be arranged adjacent to and downstream of the catalyst 214.

The third baffle plate 222 can be positioned upstream and in proximity of the second end cap 210. The second baffle plate 220 can be arranged between the first baffle plate 218 and the third baffle plate 222. The baffle plates 218, 220, and 222 may be arranged within the housing 202 by coupling the baffle plates 218, 220, and 222 to the housing 202. The baffle plates 218, 220, and 222 may be coupled to the housing 202 by any suitable method such as, but not limited to, welding, bolting etc. known in the art.

The one or more baffle plates can be arranged to define one or more resonator chambers. For example as shown in FIGS. 2 and 3, the baffle plates 218, 220, and 222 can be arranged within the housing 202 to define a first resonator chamber 224 and a second resonator chamber 226, although less baffle plates can be arranged to define one of the resonator chambers. Two of the baffle plates can be arranged to define the first resonator chamber 224 within the housing 202, shown in FIG. 2 as being defined between the first baffle plate 218 and the second baffle plate 220. Further, two of the baffle plates can be arranged to define the second resonator chamber 226 within the housing 202, shown in FIG. 2 as being defined between the second baffle plate 220 and the third baffle plate 222. As, the third baffle plate 222 may be positioned at a longitudinal distance from the second end cap 210, a third chamber 228 may be defined between one of the baffle plates, such as, e.g. the third baffle plate 222, and the second end cap 210. Further, with additional reference to FIG. 3, the first baffle plate 218, the second baffle plate 220, and the third baffle plate 222 respectively define a first opening 230, a second opening 232, and a third opening 234. The baffle plates 218, 220, and 222 are arranged within the housing 202 such that the openings 230, 232, and 234 are axially aligned to each other about the longitudinal axis B-B of the housing 202.

The muffler assembly 216 further includes a resonator tube 236 extending through the openings 230, 232, and 234 of the baffle plates 218, 220, and 222. The baffle plates 218, 220, and 222 are operable to provide a support for the resonator tube 236 so as the resonator tube 236 can be maintain in a fixed orientation within the housing 202. In an embodiment, the resonator tube 236 is press fitted or snap fitted into the openings 230, 232, and 234. In an embodiment, the resonator tube 236 may be coupled to the any or all the baffle plates 218, 220, and 222 by any suitable method known in the art. In an embodiment, the housing 202 may include one or more suitable structure to rigidly support the resonator tube 236.

The resonator tube 236 may include one or more of the following: an inlet 238, an outlet 240, and a perforated portion 242 formed in a wall 244 of the resonator tube 236. The inlet 238 is in fluid communication with the catalyst 214 and receives the exhaust gas exiting the catalyst 214. Also, the resonator tube 236 may include one or more outlet ports 246 defined in a portion of the wall 244 of the resonator tube 236. In one example, the one or more outlet ports 246 may be formed in the wall 244 of the resonator tube 236 to be in fluid communication with the first resonator chamber 224.

In the illustrated embodiment, a single outlet port 246 is included. The outlet port 246 is in fluid communication with the first resonator chamber 224 and discharges a portion of exhaust gas in the first resonator chamber 224 from the resonator tube 236. The exhaust gas entered in the first resonator chamber 224 may be reflected multiple times by the first baffle plate 218 and the second baffle plate 220, thereby creating standing waves inside the first resonator chamber 224. Therefore, the first resonator chamber 224 together with the outlet port 246 may help in attenuating noise in a low frequency band. The dimensions, e.g. length of the first resonator chamber 224, and the number of outlet ports 246 may depend on the frequency band of the noise to be attenuated. In the illustrated exemplary embodiment, the first resonator chamber 224 and the outlet port 246 may be configured to attenuate the noise generated by the engine 104 due to a specific firing order of the combustion cylinders C1 to C6. Although a single outlet port 246 is contemplated, it may be appreciated that there may be multiple outlet ports defined in the portion of the resonator tube 236 present in the first resonator chamber 224 depending of the frequency band of the noise to be attenuated.

Further, as shown in FIG. 2 and FIG. 3, the perforated portion 242 of the resonator tube 236 is disposed between the second baffle plate 220 and third baffle plate 222. The perforated portion 242 can be positioned to be in fluid communication with the second resonator chamber 226 and to facilitate flow of the exhaust gas from the resonator tube 236 to the second resonator chamber 226. In the second resonator chamber 226, the exhaust gas may undergo multiple reflections from the second baffle plate 220 and the third baffle plate 222 before exiting the second resonator chamber 226 through one or more apertures 248 defined by the third baffle plate 222. In one example, the one or more apertures 248 can be axial openings formed in the third baffle plate 222, and can be formed to be axially aligned with the resonator tube 236. The second resonator chamber 226 is configured to attenuate the noise in high frequency band. The exhaust gas may enter in the third chamber 228 from the second resonator chamber 226 through the apertures 248.

Furthermore, a plug member 250 may be inserted in the outlet 240 formed at an end 252 of the resonator tube 236 to close the outlet 240 and prevent flow of the exhaust gas from the outlet 240 to the third chamber 228. The plug member 250 may include one or more ports 254 though which exhaust gas may enter into the resonator tube 236 from the third chamber 228. This helps in managing a backpressure of the exhaust gas. The exhaust gas exist the exhaust after-treatment assembly 200 from the third chamber 228 via the outlet port 206.

Figure 4:
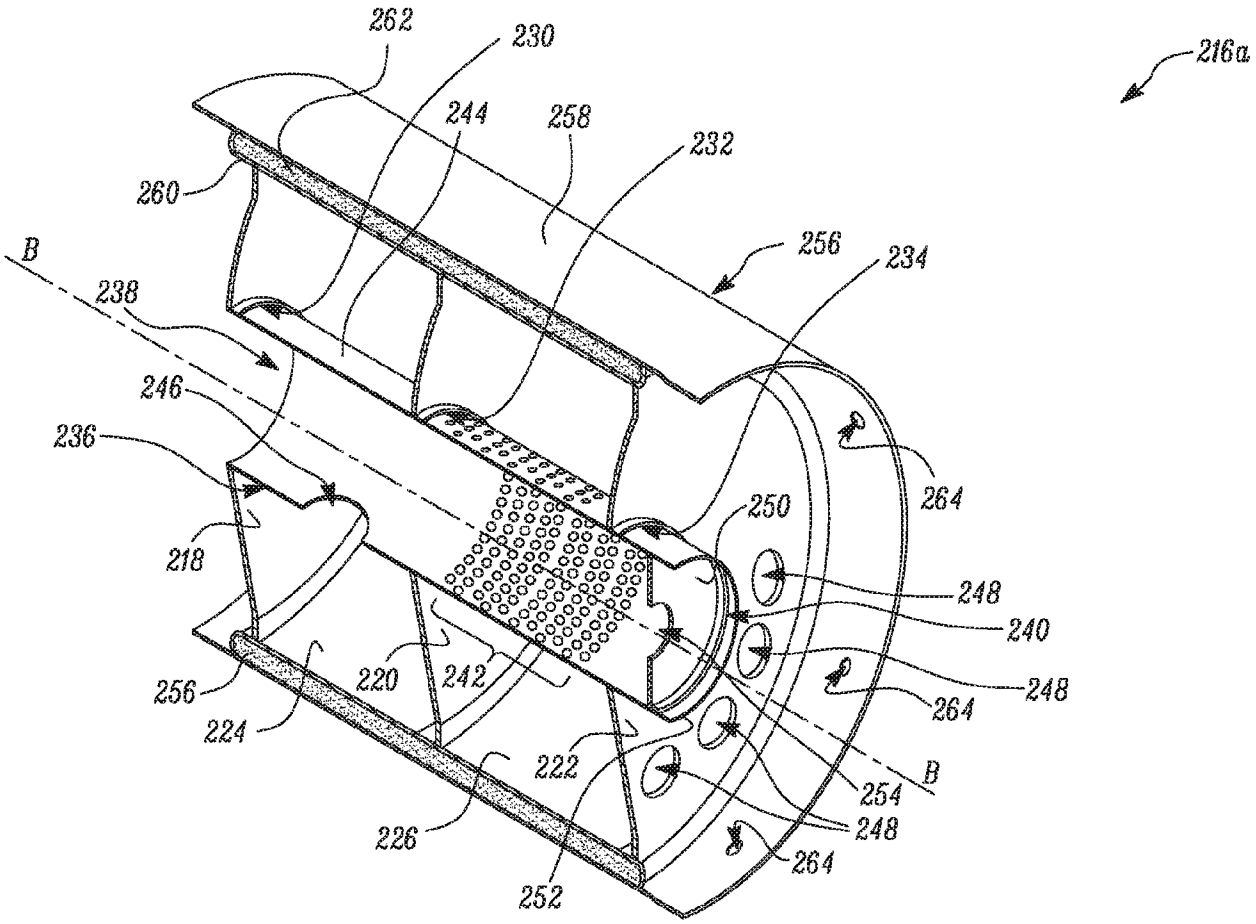
FIG. 4 illustrates a sectional view of an alternative muffler assembly for the exhaust after-treatment assembly, in accordance with an embodiment of the disclosure.

Referring to FIG. 4, a muffler assembly **216*a* is shown according to an alternative embodiment of the exhaust after-treatment assembly 200. The muffler assembly 216*a* may include a canister 256 formed by assembling an outer shell 258, an inner shell 260, and an insulation member 262. The insulation member 262 may be sandwiched between the outer shell 258 and the inner shell 260. Further, the ends of the inner shell 260 may be coupled with the outer shell 258. The inner shell 260 may be coupled with the outer shell 258 by a suitable method, such as, but not limited to, welding, bolting, etc. Also, the muffler assembly 216*a* may include one or more engagement structures 264 to enable proper positioning of the muffler assembly 216*a* within the housing 202. In the illustrated embodiment, the engagement structures 264 are holes defined in the outer shell 258 and/or the inner shell 260 of the canister 256. In an embodiment, the engagement structures 264 may be pins protruding from the outer shell 258 in a radially outward direction. The engagement structures 264 may engage the corresponding structures within the housing 202 such that the first baffle plate 218 is adjacent and downstream to the catalyst 214**.

Further, the muffler assembly **216*a* may include the first baffle plate 218, the second baffle plate 220, the third baffle plate 222, and the resonator tube 236, arranged inside the canister 256 in a similar manner as the components of the muffler assembly 216 are arranged within the housing 202 as explained earlier in reference to FIG. 2 and FIG. 3. Therefore, the muffler assembly 216***a* may be assembled separately and then inserted in the housing 202 and positioned downstream of the catalyst 214. In an embodiment, the muffler assembly 216*a* may be coupled with the housing 202 and/or the catalyst 214 by any suitable method known in the art. In an embodiment, the muffler assembly 216*a* may be snap fitted with the housing 202.

Figure 5:
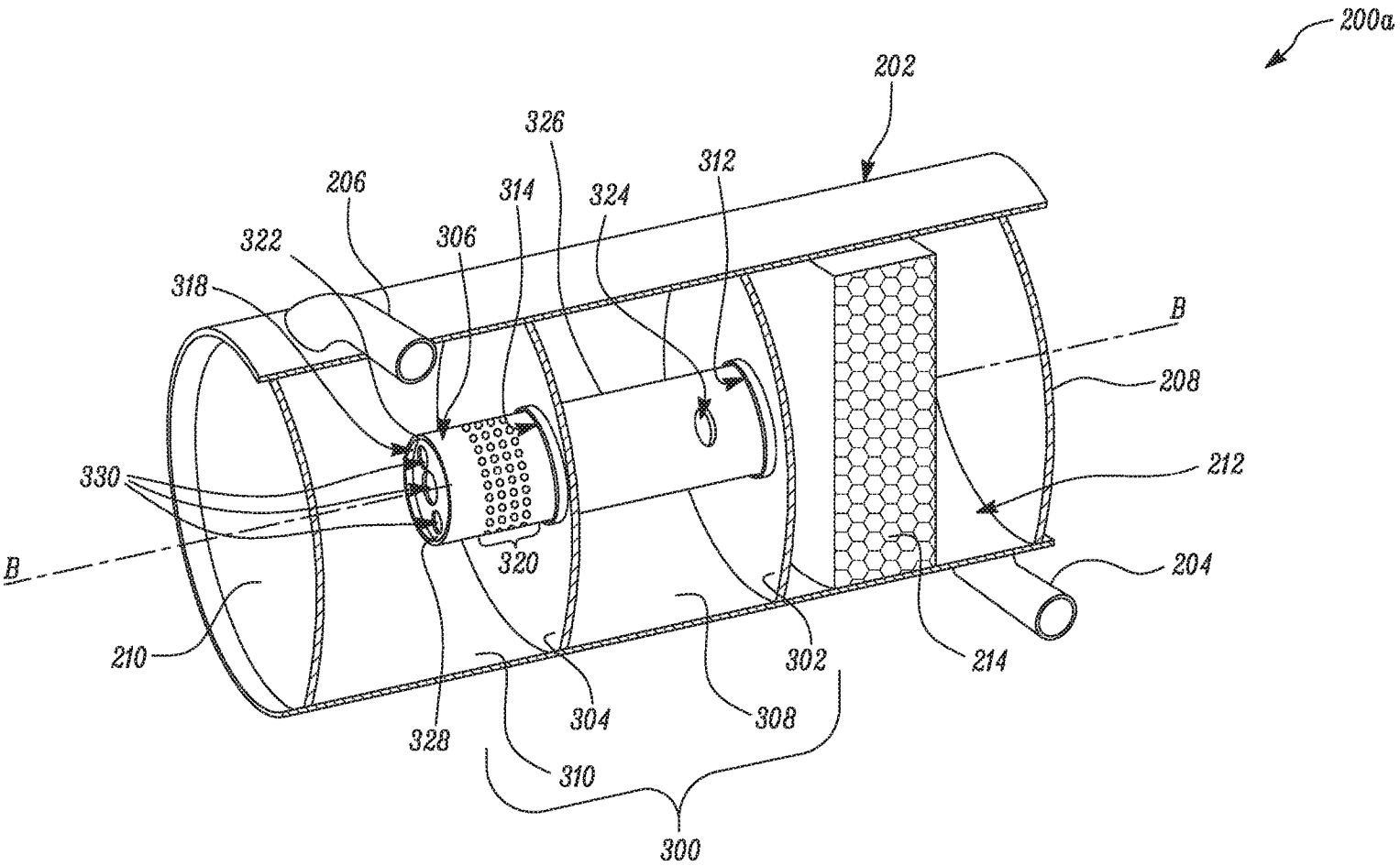
FIG. 5 illustrates a sectional view of an alternative exhaust after-treatment assembly, in accordance with an embodiment of the disclosure.

Referring to FIG. 5, an exhaust after-treatment assembly 200*a* is shown according to an alternative embodiment of the disclosure. The exhaust after-treatment assembly 200*a* may include the housing 202 having the first end cap 208, the second end cap 210, the inlet port 204, and the outlet port 206. The second end cap 210 can be positioned in close proximity to the outlet port 206 and the first end cap can be positioned in close proximity to the inlet port 204. The exhaust after-treatment assembly 200*a* may further include the catalyst 214 disposed within the cavity 212 of the housing 202 and in proximity to the inlet port 204. Also, a muffler assembly 300 is arranged within the cavity 212 of the housing 202 and positioned downstream of the catalyst 214.

The muffler assembly 300 includes a first baffle plate 302, a second baffle plate 304, and a resonator tube 306. The first baffle plate 302 and the second baffle plate 304 are longitudinally spaced from each other within the cavity 212 of the housing 202 such that a first resonator chamber 308 is defined between the first baffle plate 302 and the second baffle plate 304. Further, a second resonator chamber 310 is defined between the second baffle plate 304 and the second end cap 210. The first baffle plate 302 is arranged in proximity to the catalyst 214 and the second baffle plate 304 is positioned further downstream of and longitudinally spaced from the first baffle plate 302. The first baffle plate 302 and the second baffle plate 304 may be positioned parallel to each other and perpendicular to the longitudinal axis B-B of the housing 202.

As shown in FIG. 5, the first baffle plate 302 and the second baffle plate 304 are arranged such that a first opening 312 of the first baffle plate 302 and a second opening 314 of the second baffle plate 304 are aligned to each other about the longitudinal axis B-B of the housing 202. The resonator tube 306 extends through the first opening 312 and the second opening 314 and includes an inlet 316, an outlet 318, and a perforated portion 320. The outlet 318 may be formed at end 322 of the resonator tube 306. Further, the resonator tube 306 may include one or more outlet ports 324 formed in a portion of a wall 326 of the resonator tube 306 between the first baffle plate 302 and the second baffle plate 304. In the illustrated embodiment, the resonator tube 306 includes a single outlet port 324. The outlet port 324 is in fluid communication with the first resonator chamber 308 and facilitates flow of a portion of exhaust gas to the first resonator chamber 308.

Further, the perforated portion 320 is formed in the wall 326 and can be arranged in the second resonator chamber 310 to facilitate flow of the exhaust gas to the second resonator chamber 310 from the resonator tube 306. The exhaust gas in the second resonator chamber 310 may undergo multiple reflection by the second baffle plate 304 and the second end cap 210 before existing the exhaust after-treatment assembly 200*a* via the outlet port 206. The first resonator chamber 308 is configured to attenuate noise of low frequency band and the second resonator chamber 310 is configured to attenuate noise of high frequency band. The low frequency band is generally a strong or objectionable frequency produced by the engine or machine to which the muffler assembly 300 is attached.

Again referring to FIG. 5, a plug member 328 may be inserted in the outlet 318 of the resonator tube 306 to close the outlet 318 and prevent flow of the exhaust gas from the outlet 318. The plug member 328 may include one or more ports 330 though which exhaust gas may enter into the resonator tube 306 from the second resonator chamber 310. This helps in managing a backpressure of the exhaust gas. The exhaust gas exist to atmosphere from the second resonator chamber 310 via the outlet port 206. FIG. 5 shows the three ports 330, where one of the ports 330 is formed along an intermediate portion of the plug member 328 and the other two ports 330 are formed between the outer periphery of the plug member 328 and the intermediate port 330.

Figure 6:
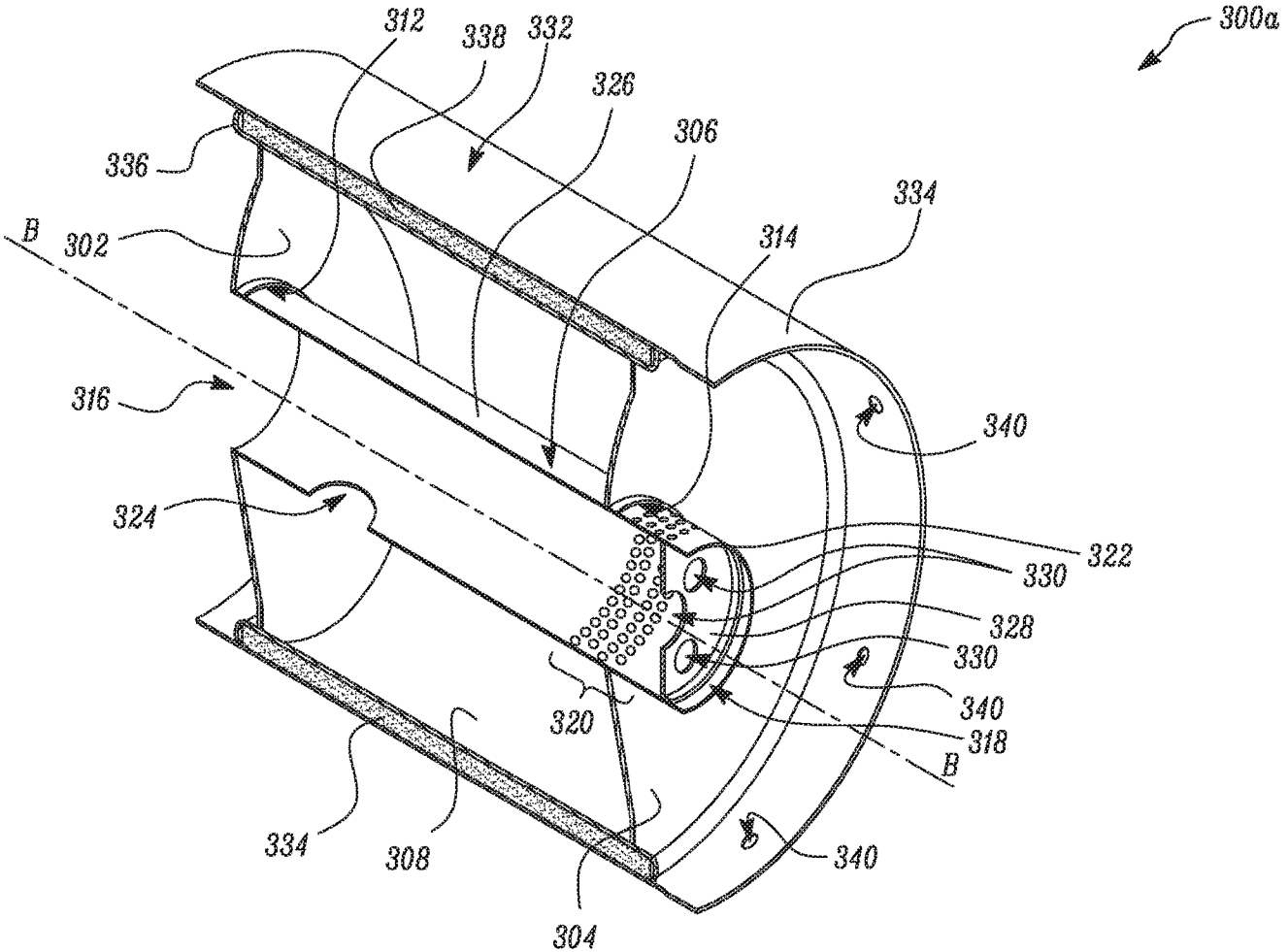
FIG. 6 illustrates a sectional view of an alternative muffler assembly for the alternative exhaust after-treatment assembly, in accordance with an embodiment of the disclosure.

Referring to FIG. 6, a muffler assembly 300*a* is shown according to an alternative embodiment of the exhaust after-treatment assembly 200*a*. The muffler assembly 300*a* may include a canister 332 formed by assembling an outer shell 334, an inner shell 336, and an insulation member 338. The insulation member 338 may be sandwiched between the outer shell 334 and the inner shell 336. Further, the ends of the inner shell 336 may be coupled with the outer shell 334. The inner shell 336 may be coupled with the outer shell 334 by a suitable method, such as, but not limited to, welding, bolting, etc. Also, the muffler assembly 300*a* may include one or more engagement structures 340 to enable proper positioning of the muffler assembly 300*a* within the housing 202. In the illustrated embodiment, the engagement structures 340 are holes defined in the outer shell 334 and/or inner shell 336 of the canister 332. In an embodiment, the engagement structures 340 may be pins protruding from the outer shell 334 in a radially outward direction. The engagement structures 340 may engage with the corresponding structures within the housing 202 such that the first baffle plate 302 is adjacent to the catalyst 214 when arranged in the cavity 212 of the housing 202.

Further, the muffler assembly 300*a* includes the first baffle plate 302, the second baffle plate 304, and the resonator tube 306, arranged inside the canister 332 in a similar manner as the components of the muffler assembly 300 are arranged within the cavity 212 of the housing 202 as explained earlier in reference to FIG. 5. Therefore, the muffler assembly 300*a* may be assembled separately and then inserted within the cavity 212 of the housing 202 and positioned downstream of the catalyst 214 such that the first baffle plate 302 is adjacent to the catalyst 214.

INDUSTRIAL APPLICABILITY

The pre-existing exhaust after-treatment assembly 102, as shown in FIG. 1, includes the catalyst 130 and the DPF 132. The DPF 132 may filter particulate matter present in the exhaust gas. The DPF 132 may be typically provided to confirm to emission requirements in certain jurisdictions. However, other jurisdictions may have less strict emission requirements such that the DPF 132 is not an essential component for treatment of the exhaust gas. However, when the DPF 132 is removed, the noise level generated by the engine 104 and the exhaust system 124 may increase to an undesired level.

The present disclosure is related to the exhaust after-treatment assembly 200, 200*a* including the muffler assembly 216, 216*a*, 300, 300*a* in place of the pre-existing exhaust after-treatment assembly 102. The exhaust after-treatment assembly 200, 200*a* may be used with various types of diesel engines. The diesel engines may be used in various types of machines, such as, but not limited to, excavators, bulldozers, powered shovels, trucks, cars, locomotives, and so on. The diesel engines may also be used for power generation and marine applications.

Figure 7:
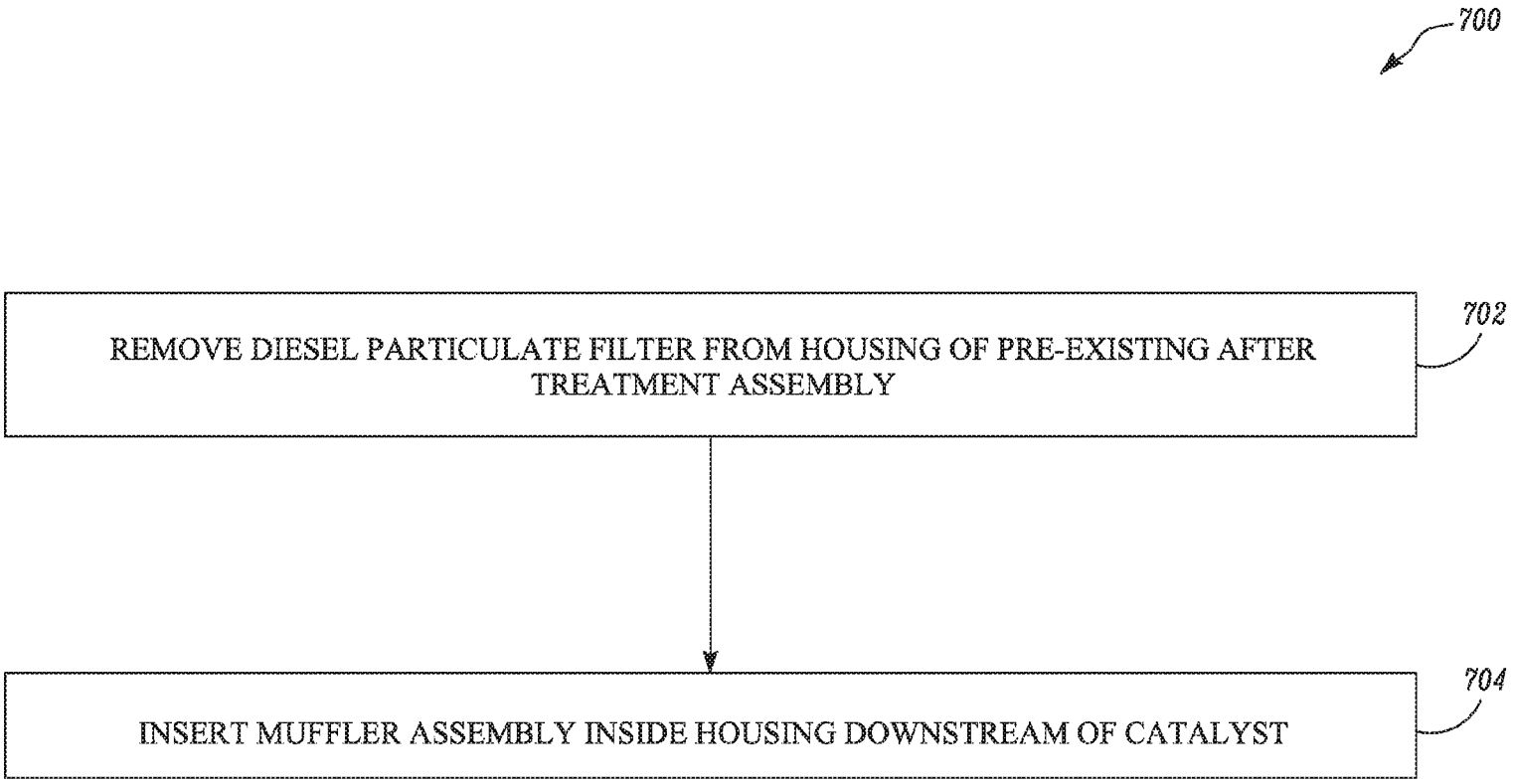
FIG. 7 illustrates a method for retrofitting a pre-existing after-treatment assembly, in accordance with an embodiment of the disclosure.

The present disclosure is also related to a method of retrofitting the pre-existing exhaust after-treatment assembly 102 by replacing the DPF 132 with the muffler assembly 216, 216*a*, 300, 300*a*. FIG. 7 illustrates a flowchart showing the method 700, according to an embodiment of the present disclosure. Reference will be also made to FIGS. 1-6 for describing the method 700 in detail.

At step 702, the DPF 132 is removed from the cavity 136 of the housing 134 of the pre-existing exhaust after-treatment assembly 102. The removal of the DPF 132 may result in a vacant space in the housing 134. The DPF 132 may be removed from the housing 134 by uncoupling the DPF 132 from the catalyst 130 and/or any other part of the housing 134. Further, in an embodiment, a regeneration routine may also be removed or disabled from a controller of the engine system 100 associated with the regeneration of the DPF 132.

At step 704, any one of the muffler assembly 216, 216*a*, 300, and 330*a* is inserted inside the housing 134 at the location of the DPF 132. However, the step 704 is described in detail by using the muffler assembly 216 alone. The muffler assembly 216 is inserted within the cavity 136 and positioned downstream of the catalyst 130. The insertion of the muffler assembly 216 includes providing the first baffle plate 218, the second baffle plate 220 and the third baffle plate 222 within the cavity 136 of the housing 134. The first baffle plate 218 is positioned adjacent and downstream of the catalyst 130. The second baffle plate 220 is positioned within the housing 134 such that the second baffle plate 220 is longitudinally spaced from the first baffle plate 218. Similarly, the third baffle plate 222 is disposed longitudinally spaced from the second baffle plate 220 within the housing 134 and positioned downstream of the second baffle plate 220. The first baffle plate 218 and the second baffle plate 220 define the first resonator chamber 224 between them and the second baffle plate 220 and the third baffle plate 222 define the second resonator chamber 226 between them. The baffle plates 218, 220, and 222 may be coupled with the housing 134 or the catalyst 130 by any suitable method known in the art.

Further, the resonator tube 236 is provided within the housing 134. The resonator tube 236 extends through the aligned openings 230, 232, and 234 of the first baffle plate 218, the second baffle plate 220, and the third baffle plate 222. Further, when the baffle plates 218, 220, and 222 are arranged within the cavity 136 of the housing 134, the openings 230, 232, and 234 are aligned about the longitudinal axis A-A. The resonator tube 236 is mounted such that inlet 238 of the resonator tube 236 is in fluid communication with catalyst 130, the outlet port 246 is in fluid communication with the first resonator chamber 224, and the perforated portion 242 is in fluid communication with the second resonator chamber 226. The openings 230, 232, and 236 of the baffle plates 218, 220, and 222 may support the resonator tube 236. In an embodiment, the resonator tube 236 may be coupled with the baffle plates 218, 220, and 222 and/or the housing 134. The resonator tube 236 may be coupled with the baffle plates 218, 220, and 222 and/or the housing 134 by any suitable method known in the art. In an embodiment, the housing 134 may include suitable structures to support and retain the resonator tube 236 in a proper position.

Although, the retrofitting of the muffler assembly 216 is described, it may be appreciated that the muffler assembly 300 (shown in FIG. 5) may be assembled in a similar manner.

In an embodiment, the retrofitting the muffler assembly 216*a* (as shown in FIG. 4) may be performed by providing the baffle plates 218, 220, 222 and the resonator tube 236 inside the canister 256 at a separate location. The baffle plates 218, 220, 222 and the resonator tube 236 may be mounted inside the canister 256 in a similar manner as the baffle plates 218, 220, 222 and the resonator tube 236 of the muffler assembly 216 is arranged within the housing 202. The muffler assembly 216*a* may be assembled in the form of a kit before being installed in the housing 134. The muffler assembly 216*a* is inserted in the housing 134 and positioned downstream of the catalyst 130 such that the first baffle plate 218 is positioned adjacent to the catalyst 130. In an embodiment, the muffler assembly 216*a* may be coupled to the housing 134 and/or to the catalyst 130. The muffler assembly 216*a* may be coupled to the housing 134 and/or the catalyst 130 by any suitable method or system known in the art. Also, the engagement structures 264 may engage the corresponding structures in the housing 134 to enable proper positioning of the muffler assembly 216*a* within the housing 134. The engagement structures 264 helps in proper assembling of the muffler assembly 216*a* such that the first baffle plate 218 is always adjacent to the catalyst 130 in the assembled position.

Although, the retrofitting of the muffler assembly 216*a* is described, it may be appreciated that the muffler assembly 300*a* (shown in FIG. 6) may be assembled in a similar manner.

Further, an operation of the engine system 100*a* having any of the exhaust after-treatment assembly 200, 200*a* is disclosed. Although, the operation of the engine system 100*a* is disclosed in conjunction with the exhaust after-treatment assembly 200, it may be appreciated the engine system 100*a* having the exhaust after-treatment assembly 200*a* may operate in a similar manner.

During operation of the engine system 100*a*, exhaust gas is discharged from any or all of the combustion cylinders C1 to C6. The exhaust gas discharged by the combustion cylinders C1 to C6 flows to the exhaust after-treatment assembly 200 via the exhaust manifold 108 and the exhaust conduit 126. The exhaust gas enters in the housing 202 via the inlet port 204. After entering the housing 202, the exhaust gas passes through the catalyst 214. The catalyst 214 treats the exhaust gas passing through it and removes the harmful constituents such as hydrocarbon, nitrous oxide etc. present in the exhaust gas. In an embodiment, the catalyst 214 may be a diesel oxidation catalyst and in such case, the catalyst 214 removes unburned hydrocarbons present in the exhaust gas.

After exiting the catalyst 214, the exhaust gas enters the muffler assembly 216 or 216*a*. The exhaust gas enters inside the resonator tube 236 via the inlet 238. As, the exhaust gas travels through the resonator tube 236, a portion or all of the exhaust gas enters into the first resonator chamber 224 via the outlet port 246. After entering the first resonator chamber 224, the exhaust gas undergoes multiple reflections from the first baffle plate 218 and the second baffle plate 220, thereby creating standing waves inside the first resonator chamber 224. The formation of standing waves help in attenuating the noise in a selected frequency band. In the exemplary embodiment, the dimensions of the first resonator chamber 224 and the outlet port 246 is selected such that the first resonator chamber 224 helps in attenuated noise in a low frequency band caused by firing order of the combustion cylinders C1 to C6.

The exhaust gas further travels down though the resonator tube 236 and exit the resonator tube 236 via the perforated portion 242 formed in the wall 244 of the resonator tube 236. The exhaust gas enters the second resonator chamber 226 from the resonator tube 236 via openings of the perforated portion 242. Again, the exhaust gas undergoes multiple reflections from the second baffle plate 220 and the third baffle plate 222 before existing the second resonator chamber 226. The exhaust gas exits the second resonator chamber 226 via the apertures 248. The standing waves formed due to multiple reflections from the second baffle plate 220 and the third baffle plate 222 in the second resonator chamber 226 together with the diffusion of exhaust gases, due to perforated portion 242, while entering the second resonator chamber 226 helps in attenuating noise in a high frequency band.

The exhaust gas enters the third chamber 228 from the second resonator chamber 226 via the apertures 248. The exhaust gas exit from the third chamber 228 via the outlet port 206 of the housing 202. The exhaust gas may exit to atmosphere or any other component after exiting the exhaust after-treatment assembly 200. Further, the exhaust gas may be at a high pressure in the third chamber 228 and creates a back pressure. In such case, a portion of the exhaust gas may enter the resonator tube 236 from the third chamber via the one or more ports 254. This helps in reducing the pressure of exhaust gas in the third chamber 228 and thereby minimizing back pressure in the exhaust after-treatment assembly 200.

In an embodiment, when the engine system 100*a* includes the exhaust after-treatment assembly 200*a* having the muffler assembly 300, 300*a* (shown in FIGS. 5 and 6), the exhaust gas exit from the second resonator chamber 310 via the outlet port 206 of the housing 202 and thereby exit the exhaust after-treatment assembly 200*a*.

In various embodiments, the diameter of the resonator tube 236, 306 the number and diameter of the outlet ports 246, 324, and/or the surface area of the perforated portion 242, 320 may vary based on the frequency band of the noise to be attenuated. Similarly, the dimensions of the first resonator chamber 224, 308 and/or the second resonator chamber 226, 310 may vary. Also, the number the resonator chambers may also vary based on the frequency band of the noise to be attenuated.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. An exhaust after-treatment assembly for an engine system comprising:

a housing having an inlet port and an outlet port, said housing defining a cavity therein;

a catalyst disposed within a first portion of the cavity defined by the housing, the catalyst selected from a group consisting of a diesel oxidation catalyst, a nitrous oxide reduction catalyst, and a combination thereof;

a second portion of the cavity located downstream of the first portion, with the second portion configured to have one of a diesel particulate filter or a muffler assembly replaceably disposed therein, the muffler assembly including:

one or more baffle plates disposed within the second portion of the cavity, the baffle plates being longitudinally spaced from one another to define at least a first resonator chamber and a second resonator chamber, each of the baffle plates further defining an opening aligned with one another about a longitudinal axis of the housing; and a resonator tube extending through the opening of each of the baffle plates, the resonator tube having an inlet to receive exhaust gas exiting the catalyst, a perforated portion formed in a wall of the resonator tube in fluid communication with the second resonator chamber, and one or more outlet ports formed in the wall of the resonator tube in fluid communication with the first resonator chamber.

2. The exhaust after-treatment assembly of claim 1, wherein the one or more baffle plates include a first baffle plate, a second baffle plate, and a third baffle plate.

3. The exhaust after-treatment assembly of claim 2, wherein the first resonator chamber is defined between the first baffle plate and the second baffle plate, and the second resonator chamber is defined between the third baffle plate and the second baffle plate.

4. The exhaust after-treatment assembly of claim 2, wherein the third baffle plate includes one or more apertures formed therein to facilitate discharge of exhaust gas from the second resonator chamber.

5. The exhaust after-treatment assembly of claim 1, wherein the one or more baffle plates include a first baffle plate and a second baffle plate.

6. The exhaust after-treatment assembly of claim 5, wherein the housing includes an end cap in close proximity to the outlet port of the housing, wherein the first resonator chamber is defined between the first baffle plate and the second baffle plate, and the second resonator chamber is defined between the end cap and the second baffle plate.

7. The exhaust after-treatment assembly of claim 1, wherein the muffler assembly includes a plug member being inserted in an outlet formed at an end of the resonator tube.

8. The exhaust after-treatment assembly of claim 7, wherein the plug member defines one or more ports, wherein the one or more ports include an axial port.

9. An engine system, the engine system comprising:

an engine;

an exhaust after-treatment assembly coupled to the engine and configured to treat the exhaust gases discharged from the engine, the exhaust after-treatment assembly including:

a housing having an inlet port and an outlet port;

a catalyst disposed within a cavity defined by the housing, the catalyst selected from a group consisting of a diesel oxidation catalyst, a nitrous oxide reduction catalyst, and a combination thereof;

one or more baffle plates disposed within the cavity of the housing and downstream of the catalyst, the baffle plates being longitudinally spaced from one another to define at least a first resonator chamber and a second resonator chamber, each of the baffle plates further defining an opening aligned with one another about a longitudinal axis of the housing; and a resonator tube extending through the opening of each of the baffle plates, the resonator tube having an inlet to receive exhaust gas existing the catalyst, a perforated portion formed in a wall of the resonator tube in fluid communication with the second resonator chamber, and one or more outlet ports formed in the wall of the resonator tube in fluid communication with the first resonator chamber.

10. The exhaust after-treatment assembly of claim 9, wherein the one or more baffle plates include a first baffle plate, a second baffle plate, and a third baffle plate.

11. The exhaust after-treatment assembly of claim 10, wherein the first resonator chamber is defined between the first baffle plate and the second baffle plate, and the second resonator chamber is defined between the third baffle plate and the second baffle plate.

12. The exhaust after-treatment assembly of claim 10, wherein the third baffle plate includes one or more apertures formed therein to facilitate discharge of exhaust gas from the second resonator chamber.

13. The exhaust after-treatment assembly of claim 9, wherein the one or more baffle plates include a first baffle plate and a second baffle plate.

14. The exhaust after-treatment assembly of claim 13, wherein the housing includes an end cap in close proximity to the outlet port of the housing, wherein the first resonator chamber is defined between the first baffle plate and the second baffle plate, and the second resonator chamber is defined between the end cap and the second baffle plate.

15. The exhaust after-treatment assembly of claim 9, wherein a plug member is inserted in an outlet formed at an end of the resonator tube.

16. The exhaust after-treatment assembly of claim 9, wherein the catalyst includes a diesel oxidation catalyst.

* * * * *